US009732954B2

(12) United States Patent
Mügge et al.

(10) Patent No.: US 9,732,954 B2
(45) Date of Patent: Aug. 15, 2017

(54) LIGHTING SYSTEM WITH A COOLING DEVICE AND AN OPTICAL BODY

(71) Applicant: Hella KGaA Hueck & Co., Lippstadt (DE)

(72) Inventors: Martin Mügge, Geseke (DE); Thomas Rettweiler, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 313 days.

(21) Appl. No.: 14/421,674

(22) PCT Filed: Aug. 14, 2013

(86) PCT No.: PCT/EP2013/066975
§ 371 (c)(1),
(2) Date: Feb. 13, 2015

(87) PCT Pub. No.: WO2014/027019
PCT Pub. Date: Feb. 20, 2014

(65) Prior Publication Data

US 2015/0198325 A1 Jul. 16, 2015

(30) Foreign Application Priority Data

Aug. 14, 2012 (DE) ..... 10 2012 107 432

(51) Int. Cl.

| | |
|---|---|
| ***F21V 29/00*** | (2015.01) |
| ***F21V 29/74*** | (2015.01) |
| ***F21S 8/10*** | (2006.01) |
| ***F21V 29/50*** | (2015.01) |
| *F21Y 115/10* | (2016.01) |

(52) U.S. Cl.
CPC ..... *F21V 29/74* (2015.01); *F21S 48/321* (2013.01); *F21S 48/328* (2013.01); *F21V 29/50* (2015.01); *F21S 48/1159* (2013.01); *F21Y 2115/10* (2016.08)

(58) Field of Classification Search
CPC ..... F21S 48/321; F21S 48/328; F21V 17/00; F21V 17/002; F21V 17/10; F21V 17/104; F21V 29/50; F21V 29/74
USPC ..... 362/232, 249.02, 294, 311.02, 800
See application file for complete search history.

(56) References Cited

U.S. PATENT DOCUMENTS 7,654,703 B2 * 2/2010 Kan ..... F21V 5/002 362/218

FOREIGN PATENT DOCUMENTS

| | | | |
|---|---|---|---|
| DE | 102004052348 | B4 | 8/2009 |
| DE | 202011052004 | U1 | 5/2012 |
| EP | 1970617 | A1 | 9/2008 |
| EP | 2236914 | A1 | 10/2010 |
| EP | 2375142 | A2 | 10/2011 |
| EP | 2484959 | A2 | 8/2012 |

(Continued)

*Primary Examiner* — Jason Moon Han
(74) *Attorney, Agent, or Firm* — Husch Blackwell LLP

(57) ABSTRACT

The invention relates to a cooling device (10) for at least one light source (110) located in a lighting system (100) and having a cooling body (20), which comprises at least one contact surface (22) for absorbing heat from the at least one light source (110) and at least one cooling element (24) for emitting the absorbed heat, characterized in that the cooling body (20) has a mechanical interface (26) which is designed for an optional arrangement of counter-interfaces (66) of at least two different optical components (50).

4 Claims, 6 Drawing Sheets

(56) References Cited

FOREIGN PATENT DOCUMENTS

Figure 1:
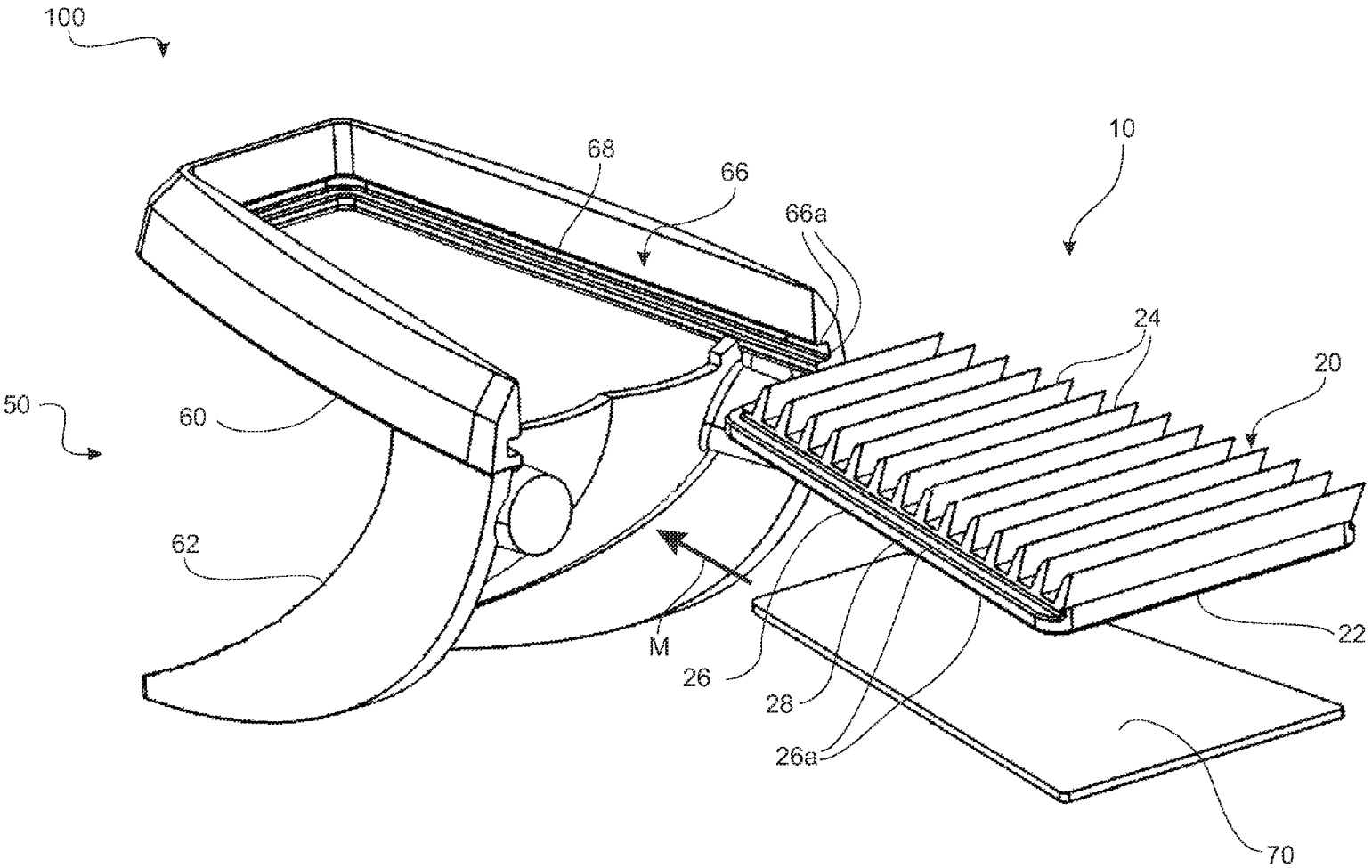

| | | | |
|---|---|---|---|
| WO | 2012036261 | A1 | 3/2012 |
| WO | 2012048351 | A1 | 4/2012 |

* cited by examiner

LIGHTING SYSTEM WITH A COOLING DEVICE AND AN OPTICAL BODY

The present invention relates to a cooling device, an optical component, a lighting system having a cooling device and an optical component, as well as a method for assembling a lighting system.

Lighting systems, as well as cooling devices and optical components for lighting systems are generally well-known. For example, they are used in motor vehicles to form light modules or light units. In modern lighting systems frequently LEDs are used as illuminants. Depending on the light intensity to be achieved, these LEDs are expected to have a very high output. In particular, high-performance LEDs with an output of between one and multiple watts are used. Besides light emission, these LEDs produce also heat when activated. Since heat has an effect on the performance and negatively influences also the lifetime of the LED, the heat has to be dissipated. Therefore, well-known lighting systems use a cooling device which usually has rib-like structures for increasing the surface. As a result of this direct contact between the cooling device with the cooling ribs and the LED, heat can be dissipated in an adequate manner.

However, the well-known lighting systems have the disadvantage that the cooling device has to be exactly adjusted to the respective situation of installation. Therefore, not only was it required to design for each new operating condition a new optical component in the form of a light conductor or TIR body or reflection body, but it was also required to design and produce a respective cooling device. From a structural aspect this involves increased expenditures. It also increased the production expenses because new tools had to be produced and tested. In particular, the previous solution of well-known lighting systems for individual cooling devices conflicts with the desired concept of interchangeable components to be used in respective operating conditions, i.e., the reduction of different components involving various model series.

It is the object of the present invention to eliminate, at least partially, the disadvantages described above. In particular, it is the object of the present invention to provide a lighting system, which has a cooling device and an optical component, as well as providing such a cooling device and such an optical component and a method for assembling a lighting system, which allows in a cost-effective and simple manner to reduce the parts for different optical lighting systems and thus for different optical components.

The above-mentioned problem is solved by a cooling device which has the characteristics of Claim 5, a lighting system which has the characteristics of Claim 8 and by a method which has the characteristics of Claim 10. Further characteristics and details of the invention are included in the sub-claims, the description and the drawings. At the same time, the characteristics and details described in the context of the invention-based cooling device apply also in the context of the invention-based optical component, the invention-based lighting system and the invention-based method, as well as conversely, so that with respect to the disclosure the individual aspects of the invention are or can be referred to in a reciprocal manner.

An invention-based cooling device for at least one light source in a lighting system comprises a cooling body. Said cooling body is provided with at least one contact surface for absorbing heat from the at least one light source. In addition, the cooling body comprises at least one cooling element for emitting the absorbed heat. An invention-based cooling device is characterized in that the cooling body has a mechanical interface which is designed for an optional arrangement of counter-interfaces of at least two different optical components.

The cooling capacity of the invention-based cooling device is based on well-known cooling devices. Preferably, such cooling devices have a plate-like construction so that one side can be designed as contact surface and the opposite side as heat-emitting surface comprising cooling elements. In particular, the cooling elements can have the objective of increasing the surface, for example, by having a rib-like structure.

However, it is possible to use an invention-based cooling device for different, at least two different optical components. For this purpose, the cooling body has a mechanical interface, which is designed for arranging, especially mounting the cooling body, and thus the cooling device, on at least two different optical components. At the same time, the mechanical interface involves that the user of an invention-based cooling device has the option of using it on at least two different optical components. For example, the optical components are specifically adjusted to different motor vehicles. In particular, this specific adjustment involves the optical properties of these optical components. In addition, these optical components are provided with a counter-interface which interacts with the mechanical interface of the invention-based cooling device. In this way, it is possible to use the cooling device on one of the counter-interfaces of the respective optical component, as well as on the other counter-interface. It is also possible to provide more than two different optical components with respective counter-interfaces, making it possible to use an invention-based cooling device on a plurality of different optical components. The interface of the cooling device and the counter-interfaces of the optical components can be used universally in both directions.

As a result, the cooling device, especially the cooling body, can be produced in high quantities. In addition, the cooling device has to be configured only once. Besides the reduced construction costs, the high number of pieces results also in considerably reduced component costs. This particular cooling device can be used for a variety of optical components, for example, in different motor vehicles. This allows for a concept of interchangeable components for the cooling device for a variety of optical components.

Preferably, the material of the cooling body, especially between the contact surface and the cooling elements, is provided with high heat conductivity and low heat conductivity resistance. Preferably, it is also possible that the illuminants, or a circuit board carrying the illuminants, can be directly attached to the cooling body. Preferably, the illuminant of the light source involves an LED, especially a high-performance LED with an output of more than one watt. It is also possible to use more than one light source or more than one illuminant for an invention-based cooling device. Preferably, the respective carrier board of the light source can be attached to the cooling device, especially the cooling body, by means of mounting devices. For example, the circuit board with the LEDs can be glued, screwed or otherwise fixed on the contact surface of the cooling device, allowing for perfect heat transmission between the light sources on the circuit board and the cooling device, in particular the cooling body.

In the context of the present invention, a mechanical interface involves a geometric design of a portion of the cooling body. In particular, such a mechanical interface has at least one abutment portion, which can be supported on a counter-abutment portion of the optical component. It is also possible to provide more complex geometric designs for the mechanical interface and correspondingly for the mechanical counter-interfaces. Preferably, the mechanical interface does not only allow for arranging but also for mounting. For example, the mechanical interface can be used for clicking or inserting in the respective counter-interface of the optical component.

In the context of the present invention, an optical component involves especially a component which has a direct or indirect effect on the light emitted by the light source. For example, an indirect effect involves a reflective surface so that light emitted by the light source and impacting the optical component is deflected by the reflective surface. It is also possible to have a direct effect on the light by designing the optical component at least section-wise in the form of a light-conducting component, especially in the form of a so-called TIR (total internal reflection) body.

An invention-based cooling device can be further developed in that the mechanical interface has at least one abutment surface for mounting on at least one counter-abutment surface of the optical component. It is not required that these surfaces are located in a plane. However, it is advantageous when the abutment surface, as well as the counter-abutment surface have a planar extension. This results in an especially advantageous planar contact and low production costs. It is also possible to provide more than one abutment surface and thus more than one counter-abutment surface, allowing for a more secure arrangement, preferably attachment of the cooling device on the optical component. At the same time, the abutment surface and the counter-abutment surface involve special geometrically designed portions of the optical component or the cooling body.

In the context of the present invention, a cooling device can be further developed in that the at least one abutment surface and the at least one counter-abutment surface form a guide element which is especially designed for guiding a rib in a groove. In particular, this guide element serves as a mounting movement in a mounting direction. For example, the guide element can be designed in the form of a rib in a groove, wherein the rib is shaped in such a way that it allows for a variety of security directions. Preferably, only one direction is defined as mounting direction and thus provides the only freedom of movement for the correlation between the cooling device and the optical component. For example, the rib can involve a simple extension having a basically rectangular cross-section. The present invention also allows for dovetail-shaped ribs which are guided in a respective dovetail groove. Other combinations between rib and groove an also provide a guidance, for example, to allow the cooling device to be centered more precisely in the respective counter-interface of the optical component. The cooling device, especially the cooling body, can consist of metal or plastic material. Advantageous metal materials are, for example, aluminium or copper, which are especially advantageous with respect to their heat conductivity.

An invention-based cooling device can be further developed in that the guide element comprises a mounting direction, wherein the guide element shows in mounting direction a reduction of the geometric dimensions. This increases the guiding force between the at least one abutment surface and the at least one counter-abutment surface. For example, when the guide element is designed as rib and groove, the rib shows in mounting direction a tapered free cross-section. As a result, the rib, which has a constant cross-section, has at first much clearance on both sides and remains easy to be inserted. Because of the fact that the groove is tapered in mounting direction, the rib shall ultimately come in contact with the lateral surfaces of the groove, first at least on one side and later on both sides. This increases friction and thus the contact pressure. As a result, the rib is jammed and fixed in the groove. In this way, it is possible to mount in an especially cost-effective manner the cooling device in the respective counter-interface of the optical component. In addition, it is possible to insert not only the cooling device but also a circuit board, which carries the LEDs, in the counter-interface. The tapered cross-section of such a groove results in the fact that the contact pressure between the circuit board and the contact surface can be increased and the lack of gaps can also improve the heat transmission capacity between contact surface and circuit board.

A further object of the present invention involves an optical component for affecting the direction of light of at least one light source in a light system. Such an optical component comprises an optical body which has at least one optically active surface for affecting the direction of light. Such an optical component is characterized in that the optical body has a mechanical counter-interface which is designed for an arrangement of at least one cooling device. In particular, the optical component serves as a counterpart of the invention-based cooling device so that both can form a light system, which shall subsequently be described in more detail.

In the context of the present invention, an optically active surface involves a surface which can have an effect on the direction of light. This can take place by means of external reflection, which is the case with an indirect use of the optical component. The direction of incident light is changed and the light is reflected. A direct effect is possible when the optical body is designed in the form of a light-conducting component, especially in the form of a so-called TIR body. For example, by means of a metallic coating on the external surface of the optical body an internal reflection can take place, which changes the direction of the light.

By means of the mechanical counter-interface, an invention-based optical component can interact especially with an invention-based cooling device. Accordingly, a cooling device can be used for this optical component and, as a standardized component, said cooling device can be produced in large quantities. This results in a cost-reduction of the light system which is provided with such a specific optical component and a universal invention-based cooling device.

An invention-based optical component can be further developed in that the mechanical counter-interface is designed for an arrangement of at least one cooling device according to the present invention. As a result, the optical body of the optical component comprises the counter-abutment surface or the counter-interface, as has been extensively described with regard to the invention-based cooling device. Therefore, an invention-based optical component has the same advantages as the extensively described invention-based cooling device.

Preferably, the invention-based optical component is further developed in that the optical body involves at least section-wise one of the following designs:

- Light-transmitting component
- TIR body (total internal reflection)
- Reflector
- Lens or lens-system, especially comprising at least one Fresnel lens It is certainly also possible to combine the previously described embodiments in an optical component. While light-conducting components and TIR bodies are used for directly affecting the light, the reflector serves the purpose of indirectly affecting the light. A direct effect involves light that is affected inside the body, while an indirect effect affects light impacting the optical body from the outside.

A further object of the present invention involves a lighting system which has a cooling device and an optical component. Such a lighting system is characterized in that the cooling device and/or the optical component are designed according to the invention. As a result, the invention-based lighting system has the same advantages as the extensively described invention-based optical component or an invention-based cooling device. Preferably, such a lighting system represents the installed condition, in which a specific optical component is combined with a cooling device manufactured according to the concept of interchangeable components, which can be produced in large quantities.

An invention-based lighting system can be further developed in that a circuit board is provided with the at least one light source which is especially arranged on a contact surface of a cooling body of the cooling device. In particular, this contacting arrangement is made by means of mounting devices, such as screws, adhesive surfaces, rivets or other clamp-like elements. In the context of the present invention, it is also possible to mount the contacting arrangement between circuit board and cooling body during the process of assembling, for example, when inserting it into a mutual guiding groove.

A further object of the present invention involves a method for assembling a lighting system, especially one according to the present invention, which comprises the following steps:

- providing a cooling device, especially one according to the present invention,
- selecting an optical component, especially one according to the present invention,
- arranging the cooling device via a mechanical interface on a counter-interface of the optical component.

This possibility of selecting an optical component for a universally usable cooling device is possible only by means of an invention-based lighting system. Accordingly, an invention-based method has the same advantages as the extensively described invention-based lighting system, an invention-based optical component and an invention-based cooling device.

Figure 2:
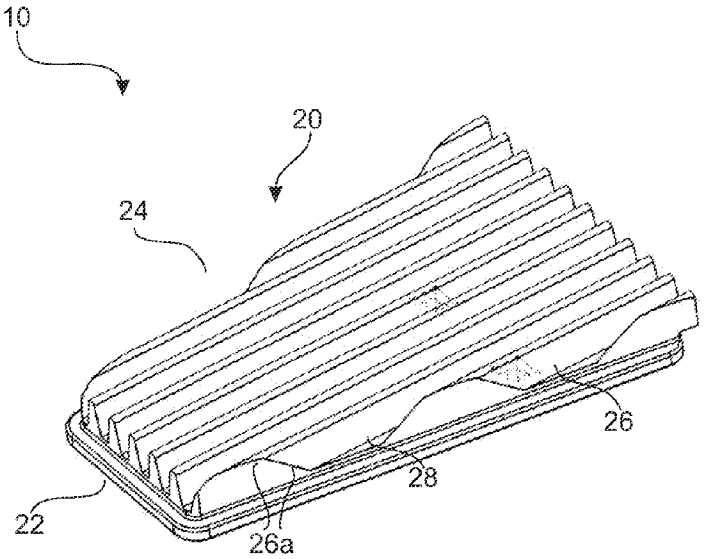
Figure 3:
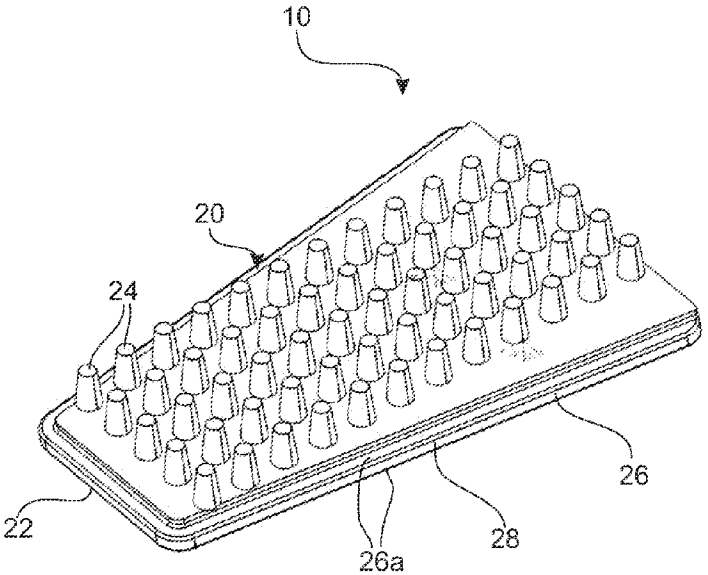
Figure 4:
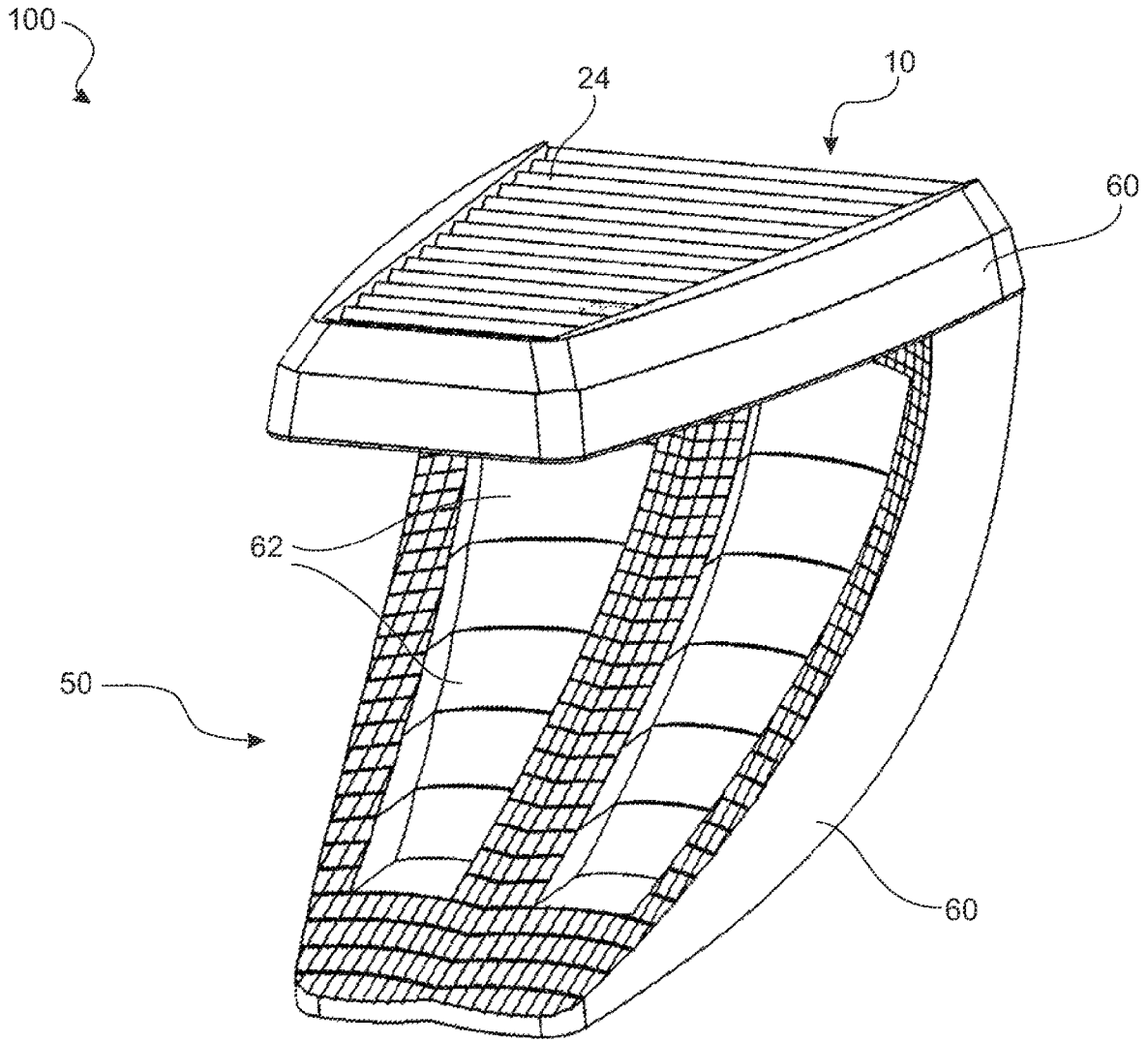
Figure 6:
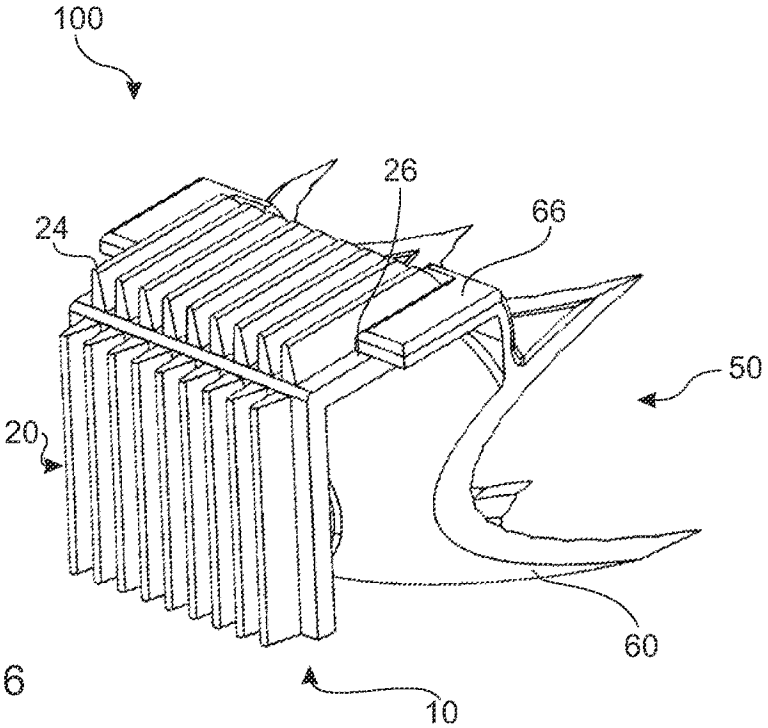
Figure 5:
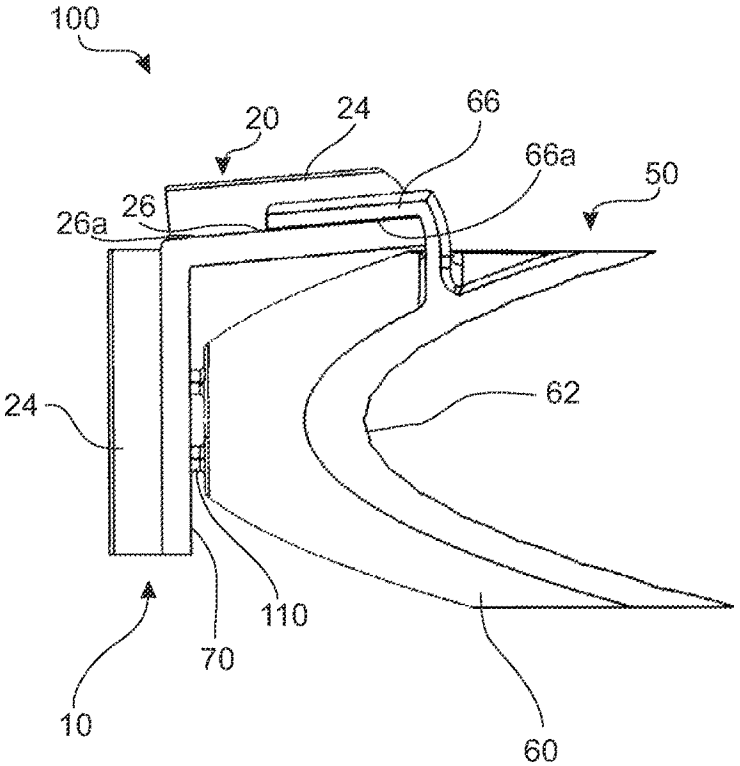
Figure 7:
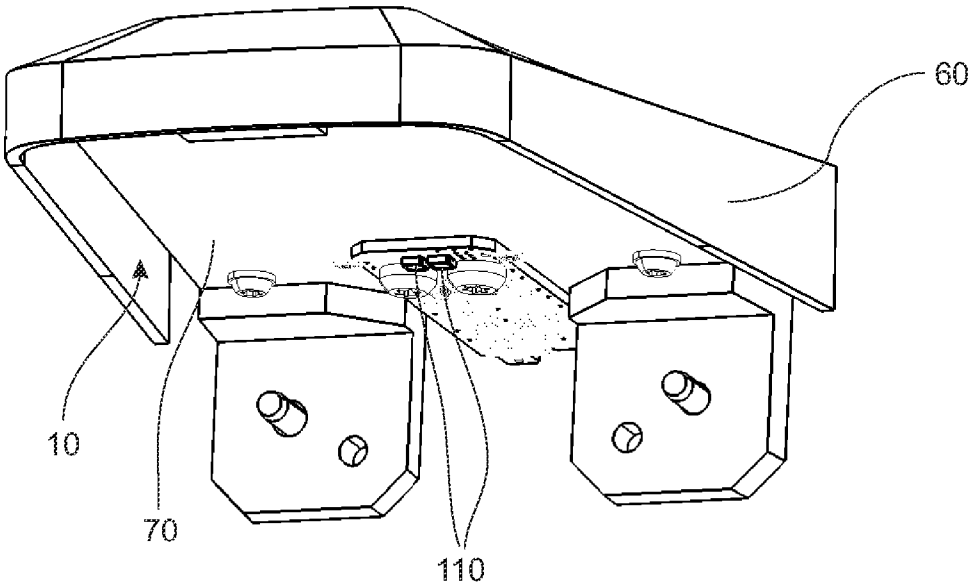
Figure 8:
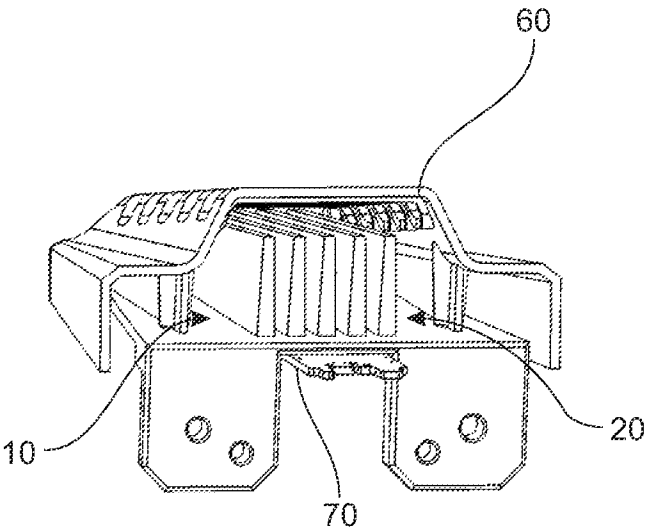
Figure 9:
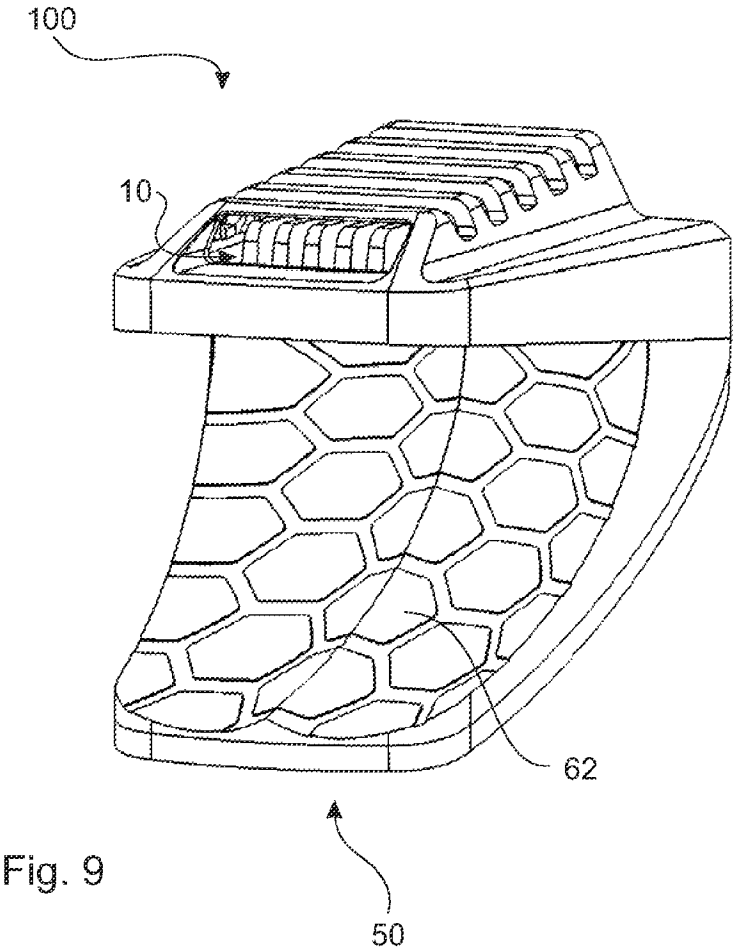

The present invention is explained in more detail by means of the figures of the attached drawings. The terms "left", "right", "top side" and "bottom side" used in the figures refer to an alignment of the figures with normally readable reference numerals. The following diagrams are shown:

FIG. 1 a first embodiment of an invention-based lighting system,

FIG. 2 an embodiment of an invention-based cooling device,

FIG. 3 a further embodiment of an invention-based cooling device,

FIG. 4 a further embodiment of an invention-based lighting system,

FIG. 5 a further embodiment of an invention-based lighting system,

FIG. 6 a rear view of the embodiment shown in FIG. 5,

FIG. 7 a partial representation of an invention-based lighting system,

FIG. 8 a further representation of the embodiment shown in FIG. 7,

FIG. 9 a further embodiment of an invention-based lighting system, and

Figure 10:
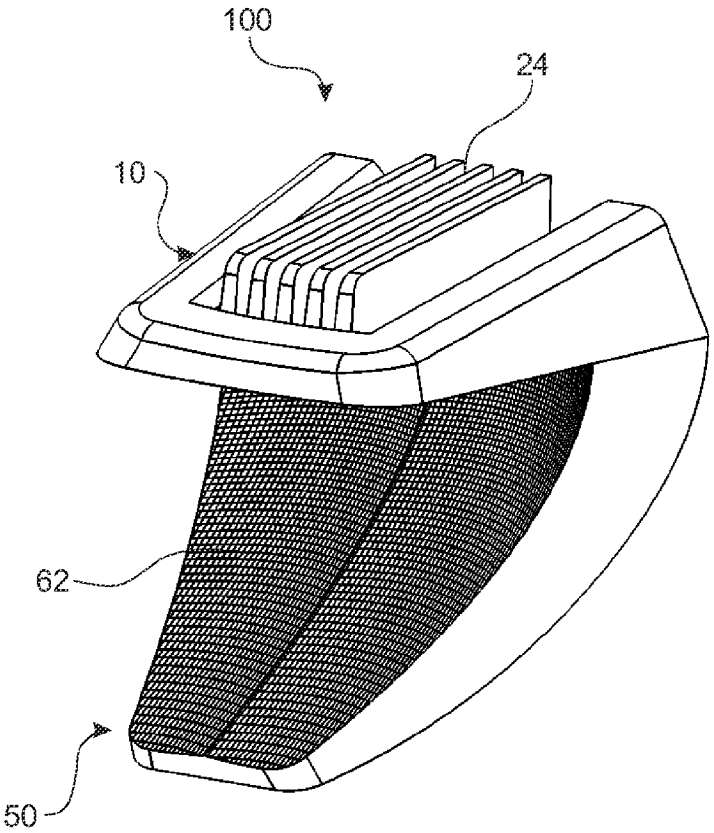

FIG. 10 a further embodiment of an invention-based lighting system.

FIG. 1 clearly shows a basic concept of the present invention. For example, the figure shows a cooling device 10, which has on its bottom side a contact surface 22 and on its top side a plurality of rib-like cooling elements 24. The cooling elements 24 and the contact surface 22 are components of a single cooling body 20, which preferably consists of metal, in particular aluminium or copper, or of plastic material. The lower left side of FIG. 1 clearly shows that a mechanical interface 26 is provided on both sides of the cooling body 20. In this case, the mechanical interface 26 is designed in the form of a rib 28 and has on its top side and on its bottom side, respectively, an abutment surface 26*a*.

In addition, on its left side the embodiment of FIG. 1 has the possibility of an optical component 50. The optical body 60 is provided with two basic components. For example, in the lower region of the optical body 60 an optically active surface faces backwards, away from the observer. On the top side, in roof-like structure of the optical body 60, the counter-interface is shown on the internal side. In this case, the counter-interface 66 is designed in the form of a groove 68 and has counter-abutment surfaces 66*a* on the top side and the bottom side. The mounting direction of the cooling device 10 is depicted by a thick arrow and reference sign M.

Moreover, in this embodiment a circuit board 70 is provided which comprises light sources 110 pointed downward (not shown). Together with the cooling device 10, it is inserted into the counter-interface 66. The insertion takes place in mounting direction M. This results in a fixed arrangement, in particular, it fixes the cooling device 10 in relation to the circuit board 70 and especially in relation to the optical component 50.

After assembling the embodiment of FIG. 1, a light system 100 is produced, which is shown in FIGS. 4, 9 and 10. FIGS. 4, 9 and 10, respectively, show a light system 100 in which the cooling device 10 is mounted on the optical component 50. In all three cases, the cooling elements 24 are located on the top side of the cooling device 10. The figures also show optically active surfaces 62 of the cooling body 60, which can be provided in a variety of ways with different interaction scenarios for the emitting light.

FIGS. 1 and 2 show two different embodiments of an invention-based cooling device 10. Preferably, the cooling device 10 is provided with identical interfaces 26 so that a variety of different cooling devices 10 can be selected, depending on the number and output of the light sources 110 on the circuit board 70. FIG. 2 shows an arrangement of longitudinal ribs and in FIG. 3 pin-like extensions are used. Besides heat dissipation, in all cases the cooling device 10 can also be modified optically, so that aspects of design can also be taken into consideration.

FIGS. 5 and 6 show a further embodiment of the invention-based light system 100. While the remaining figures show an indirect effect of the light, in this case it is provided that the light of the light sources 110 is directly affected in the optical body 60. The optical body 60 is designed in the form of a light-conducting component and comprises an optically active surface 62 as an output surface in a cushion pattern. Also here the light sources 110 are arranged on a circuit board 70, which are in full contact with a contact surface 22 of the cooling device 10. In this embodiment, the optical component 50 has counter-interfaces 66 in the form of hook-shaped extensions. These counter-interfaces 66 are slipped over respective planar portions as mechanical interfaces 26 of the cooling body 20, which results in the mounted situations shown in FIGS. 5 and 6.

FIGS. 7 and 8 show partial representations which clearly depict the circuit board 70. Each representation shows two light sources 110 in the form of LEDs which are on the top in full contact with the cooling body 20 of the cooling device 10.

The embodiments described above depict the present invention in an exemplary manner. Wherever technically practical, individual properties of the embodiments can be freely combined with one another without leaving the scope of the present invention.

REFERENCE LIST

10 cooling device
20 cooling body
22 contact surface
24 cooling element
26 mechanical interface
26*a* abutment surface
28 rib
50 optical component
60 optical body
62 optically active surface
66 counter-interface
66*a* counter-abutment surface
68 groove
70 circuit board
100 light system
110 light source
M mounting direction

The invention claimed is:

1. A cooling system comprising:

a cooling body, said cooling body comprising:

at least one light source;

at least one cooling element for emitting absorbed heat, the at least one cooling element projecting outwardly from the cooling body;

a contact surface opposing the at least one cooling element for absorbing heat from the at least one light source;

at least three external side portions each having an abutment surface, wherein each abutment surface includes a rib that protrudes outwardly from each abutment surface; and at least a first optical component and a second optical component, each of said optical components comprising at least three internal side portions each having a second abutment surface, wherein each second abutment surface includes a groove that is recessed into each second abutment surface;

wherein the first and second optical components are installed on either: (i) the same vehicle at different locations, or (ii) on different vehicles; and wherein a user may selectively install the cooling body into either the first or second optical component, wherein upon said installation, said grooves in the selected optical component receive and secure said ribs of the cooling body such that the cooling body is secured in the selected optical component.

2. The cooling system according to claim 1, wherein the rib is tapered in a mounting direction in order to increase the guiding force between the abutment surface and the second abutment surface.

3. The cooling system according to claim 1 wherein the optical component includes an optical body that includes section-wise at least one of the following: a light-transmitting component, a total internal reflection body, a reflector, and a lens or lens system.

4. The cooling system according to claim 1, wherein a circuit board is provided with the at least one light source, which is especially arranged in such a way that it is connected to a contact surface of a cooling body of the cooling device.

* * * * *